US006111554A

United States Patent [19]

Chufarovsky et al.

[11] Patent Number: 6,111,554

[45] Date of Patent: Aug. 29, 2000

[54] HELICAL ANTENNA ELEMENT

[75] Inventors: Alexander Chufarovsky, Cupertino, Calif.; Anthony Dean Arns, Vaughn, Wash.

[73] Assignee: Galtronics Ltd., Tiberias, Israel

[21] Appl. No.: 09/004,049

[22] Filed: Jan. 7, 1998

[30] Foreign Application Priority Data

Jan. 7, 1997 [IL] Israel ..... 119973

[51] Int. Cl.[7] ..... H01Q 1/36

[52] U.S. Cl. ..... 343/895; 343/745; 343/750

[58] Field of Search ..... 343/745, 895, 343/702, 750, 749; H01Q 1/36

[56] References Cited

U.S. PATENT DOCUMENTS

| | | | |
|---|---|---|---|
| 2,931,034 | 3/1960 | Harrison et al. | 343/750 |
| 3,541,554 | 11/1970 | Shirey | 343/713 |
| 3,581,249 | 5/1971 | Spangler et al. | 333/705 |
| 3,798,654 | 3/1974 | Martino et al. | 343/745 |
| 4,080,604 | 3/1978 | Wasniewski | 343/750 |
| 4,725,395 | 2/1988 | Gasparaitis et al. | 264/250 |
| 5,341,149 | 8/1994 | Salimaa et al. | 343/895 |
| 5,469,177 | 11/1995 | Rush et al. | 343/702 |
| 5,661,496 | 8/1997 | Baek et al. | 343/702 |
| 5,883,600 | 3/1999 | Kukura | 343/745 |

FOREIGN PATENT DOCUMENTS

| | | | |
|---|---|---|---|
| WO 95/08853 | 3/1995 | WIPO | H01Q 9/00 |

*Primary Examiner*—Hoanganh Le
*Assistant Examiner*—Shih-Chao Chen
*Attorney, Agent, or Firm*—Baker Botts L.L.P.

[57] ABSTRACT

A helical antenna element including a metallic coil, a dielectric support element inserted in the coil, the support element being formed with a generally hollow core, and a dielectric tuning element inserted into said core, the tuning element having at least one adjustable dimension which when adjusted, provides a tuning of an antenna characteristic.

6 Claims, 2 Drawing Sheets

HELICAL ANTENNA ELEMENT

FIELD OF THE INVENTION

The present invention relates to antennas generally and more particularly to helical antenna elements encapsulated in plastic and to methods of manufacture thereof

BACKGROUND OF THE INVENTION

Helical antenna elements encapsulated in plastic are well known. Some examples include U.S. Pat. No. 5,341,149 which describes an antenna rod with an antenna lead encapsulated in a layer of polymer material. U.S. Pat. No. 5,469,177 describes a helical antenna with a shaft translatable between a retractable position and a protractible position. PCT WO 95/08853 patent application describes a helical antenna with a variable reactance tuner. U.S. Pat. No. 4,725,395 describes a method for producing a helical antenna wherein a solid dielectric material is injection molded into a coil and an outer cover is injection molded over the coil and dielectric material.

The prior art suffers from several problems. It is desirable to completely encapsulate the helical antenna element in plastic, because the prior art has shown that this improves mechanical properties, particularly resistance to bend and impact. It is further desirable to maintain constant pitch and length of the helical coil constant during the encapsulation process, so as to produce an antenna with consistent frequency response. The prior art suggests several solutions to accomplish this. It has been found in practice, however, that maintaining the pitch and length within the required limits does not always result in antennas with the required frequency response. It is common knowledge that a thin helical antenna has narrow band width. Typically, tuning operations are applied to the helical coil before or after the encapsulation to fine tune the frequency response. However, fine tuning of the helical coil element is a cumbersome operation because the material of the element is typically a hard steel and it is difficult to cut a small amount of wire.

SUMMARY OF THE INVENTION

The present invention seeks to provide an improved helical antenna element encapsulated in plastic and a method of manufacture thereof The present invention circumvents the need for tuning a helical coil element by providing a novel method and apparatus to shift a frequency response after an encapsulation process.

There is thus provided in accordance with a preferred embodiment of the present invention, a helical antenna element including a metallic coil, a dielectric support element inserted in the coil, the support element being formed with a generally hollow core, and a dielectric tuning element inserted into said core, the tuning element having at least one adjustable dimension which when adjusted, provides a tuning of an antenna characteristic.

In accordance with a preferred embodiment of the present invention, the tuning element has a plurality of grooves formed therein which define a plurality of sections which may be selectively removed from the tuning element.

Preferably the helical antenna element is molded over with a plastical antenna element may be attached to a whip element.

BRIEF DESCRIPTION OF THE DRAWINGS

The present invention will be understood and appreciated more fully from the following detailed description, taken in conjunction with the drawings in which:

FIGS. 1–6 are simplified illustrations of a helical antenna element and a method of manufacturing therefor, in accordance with a preferred embodiment of the present invention, wherein:

FIG. 1 is a simplified, exploded, partially sectional illustration of a portion of a helical antenna element, constructed and operative in accordance with a preferred embodiment of the present invention;

FIG. 2 is a simplified, partially sectional illustration of assembling a whip element with a metallic member of the helical antenna element;

FIG. 3 is a simplified illustration of an antenna subassembly of the helical antenna element with an overmold section formed by injection molding;

FIGS. 4 and 5 are simplified illustrations of a tuning element, constructed and operative in accordance with a preferred embodiment of the present invention, respectively before and after insertion into the antenna subassembly of FIG. 3; and FIG. 6 is a simplified illustration of a finished helical antenna element, constructed and operative in accordance with a preferred embodiment of the present invention.

DETAILED DESCRIPTION OF PREFERRED EMBODIMENTS

Reference is now made to FIGS. 1–6 which illustrate a helical antenna element 10 and a method of manufacturing therefor, in accordance with a preferred embodiment of the present invention.

Figure 1:
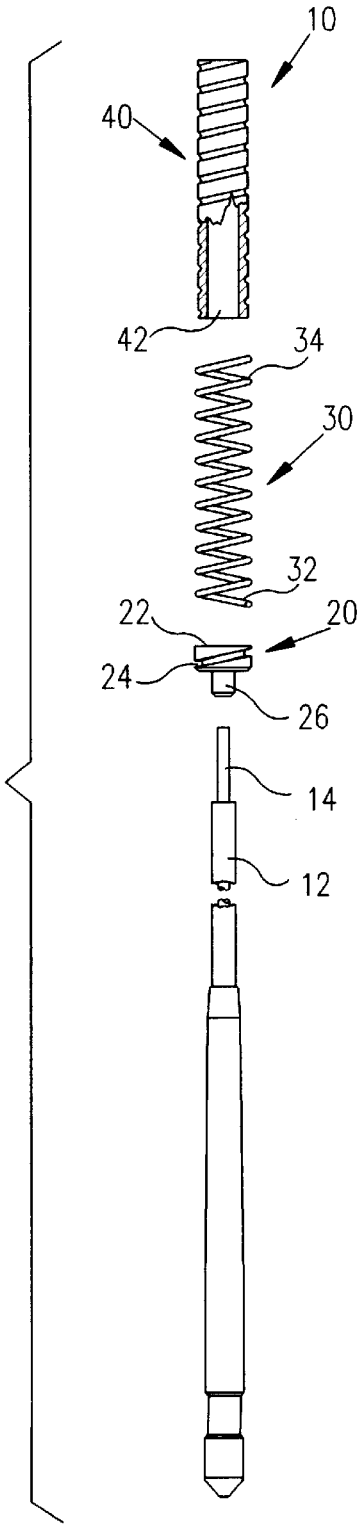
Figure 2:
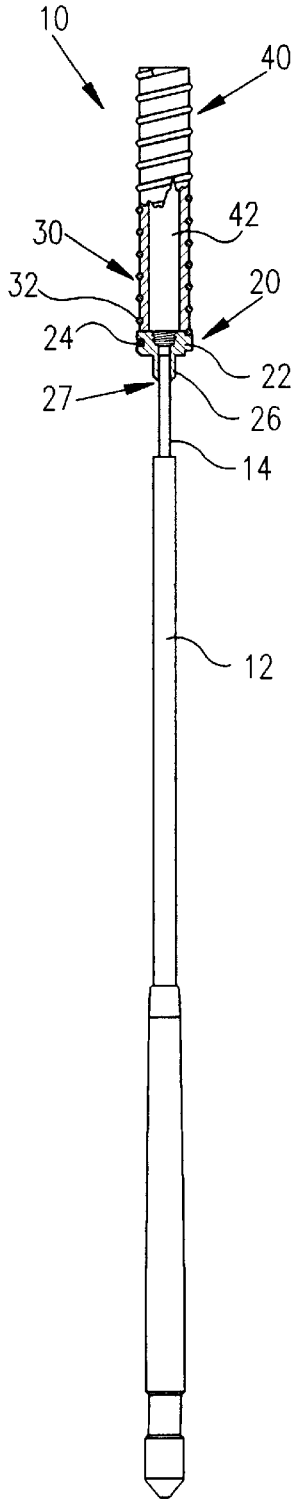

Helical antenna element 10 preferably includes a plastic coated whip element 12 which is provided with a metal core 14, exposed at an upper end thereof A metallic member 20 is preferably provided which includes an upper barrel 22 with a recess 24 formed therein, and a lower, hollow cylindrical flange 26 which protrudes from barrel 22. Barrel 22 preferably has a larger outer diameter than an outer diameter of flange 26. As seen in FIG. 2, exposed upper end 14 of whip element 12 is preferably inserted into flange 26 and crimped therewith, as seen at reference numeral 27, thereby securing whip element 12 to metallic member 20.

A helical coil 30 (FIGS. 1 and 2) is preferably connected to metallic member 20, such as by screwing a lower end 32 of coil 30 into recess 24 and crimping metallic member 20 over end 32. A dielectric support member 40 formed with a generally hollow core 42 is preferably inserted into an upper end 34 (FIG. 1) of coil 30. Support member 40 may be constructed of materials such as a low loss thermoplastic elastomer. Support member 40 is preferably screwed into coil 30 until it abuts metallic member 20.

Figure 3:
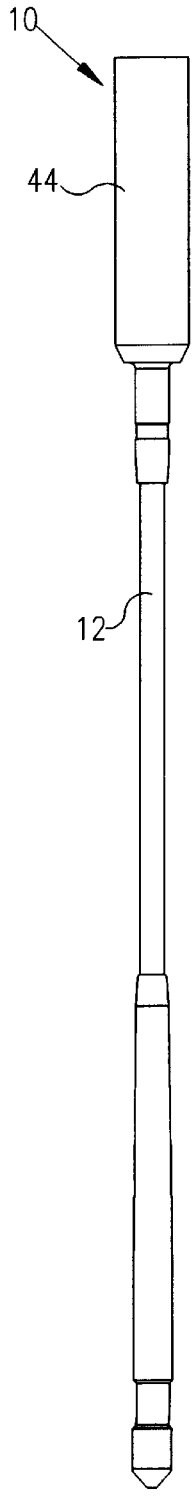

The above assembly is then placed in a mold (not shown) for injection of a plastic material over the assembly. The plastic material for injection molding may be selected from the same families of plastics/polymers suitable for support member 40. During the injection process, a metal rod (not shown) is preferably inserted into hollow core 42 in order to maintain concentricity during the mold process. As seen in FIG. 3, the molding process produces an antenna subassembly with an overmold section 44.

Figures 4, 5, 6:
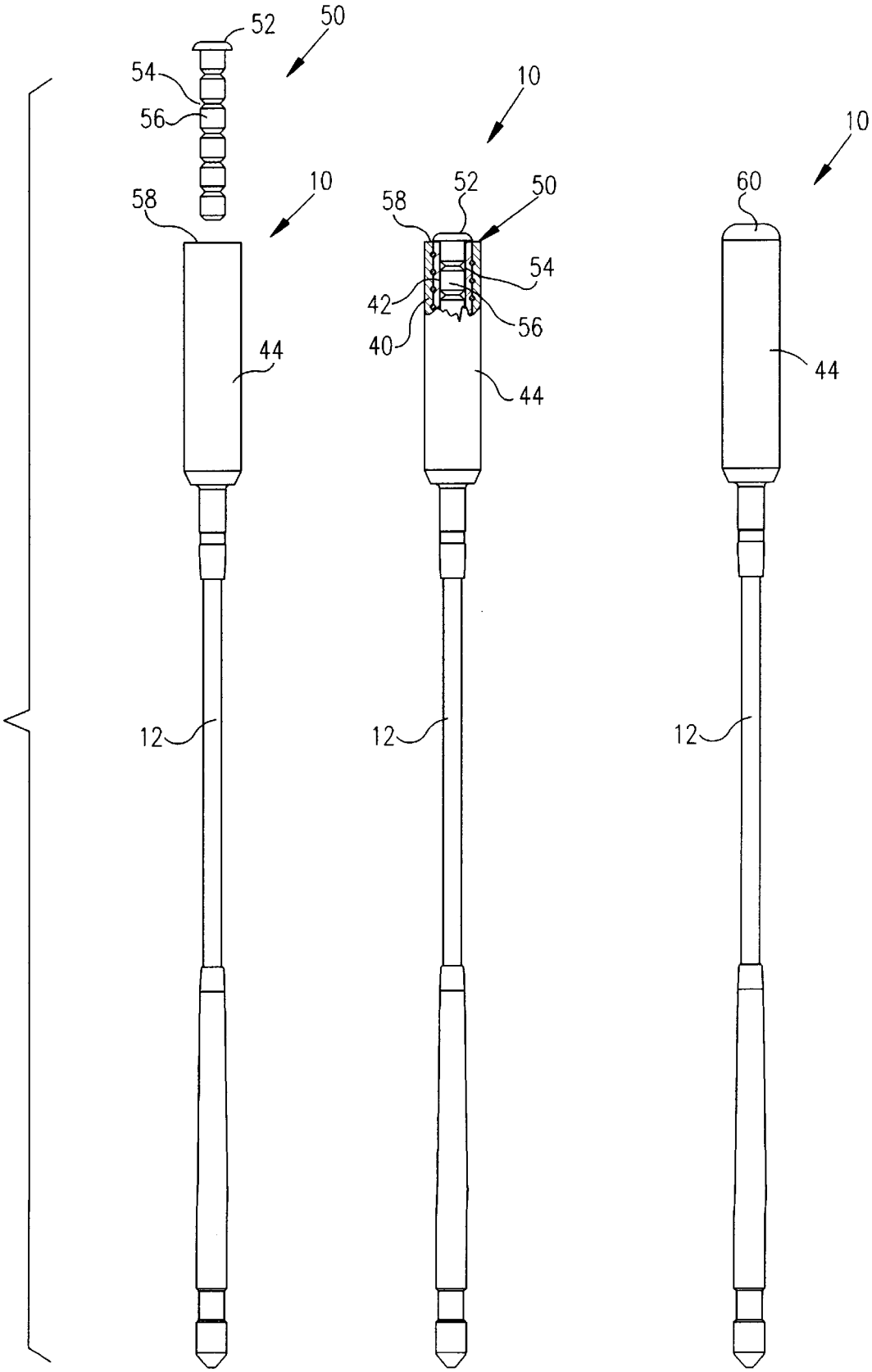

Referring now to FIGS. 4 and 5, a dielectric tuning element 50 is preferably provided with a shoulder 52. Tuning element 50 may be constructed from the same families of dielectric plastics/polymers suitable for support member 40, and can be fabricated in a variety of shapes and sizes. A plurality of grooves 54 are preferably formed along tuning element 50 thereby defining a plurality of sections 56 along the length of tuning element 50. As seen in FIG. 5, tuning element 50 is preferably inserted into hollow core 42 of support member 40 until shoulder 52 seats against an upper surface 58 of overmold section 44.

At this point, the antenna subassembly can be tested to see if a frequency response is within required limits. If the frequency response is not within the required limits, tuning element 50 can be removed, cut along one of grooves 54 to remove one or more sections 56, and reinserted into hollow core 42. The removal of sections 56 reduces the amount of dielectric material inside coil 30, thereby causing a frequency shift. The process of removing sections 56 is repeated until the desired frequency response is obtained. The antenna assembly with tuning element 50 in place is then inserted into another injection mold (not shown) to close the end of the antenna assembly with an end cap 60, thereby completing the fabrication of helical antenna element 10, illustrated in FIG. 6. Shoulder 52 of tuning element 50 prevents material from entering into hollow core 42 during the molding process.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited by what has been particularly shown and described hereinabove. Rather the scope of the present invention is defined only by the claims which follow:

What is claimed is:

1. A helical antenna element comprising:

a metallic coil;

a dielectric support element inserted in said coil, said support element being formed with a generally hollow core; and a dielectric tuning element inserted into said core, said tuning element having at least one adjustable dimension which when adjusted, provides a tuning of an antenna characteristic wherein said tuning element has a plurality of grooves formed therein which define a plurality of sections which are selectively removable from said tuning element and wherein removal of one of said sections provides a tuning of an antenna characteristic.

2. The helical antenna element according to claim 1 wherein at least one portion of said helical antenna element is molded over with a plastic.

3. The helical antenna element according to claim 1 or claim 2 wherein said helical antenna element is attached to a whip element.

4. The helical antenna element according to claim 1 or claim 2 and wherein said tuning element comprises apparatus which substantially prevents material from entering into said hollow core during overmolding of a portion of said helical antenna element.

5. A method for fine-tuning an overmolded helical antenna element comprising:

overmolding at least a portion of an antenna element;

inserting a dielectric tuning element into a portion of said antenna element, said tuning element having a plurality of grooves formed therein which define a plurality of sections which are selectively removable from said tuning element; and removing one of said sections to tune an antenna characteristic of said antenna element.

6. The method according to claim 5 wherein said removing causes a change in a frequency response of said antenna element.

* * * * *

UNITED STATES PATENT AND TRADEMARK OFFICE

CERTIFICATE OF CORRECTION

PATENT NO. : 6,111,554
DATED : August 29, 2000
INVENTOR(S) : Chufarovsky et al.

It is certified that error appears in the above-identified patent and that said Letters Patent is hereby corrected as shown below:

Column 4,
Line 15, "or" should be deleted
Line 16, "claim 2" should be deleted
Line 18, "or" should be deleted
Line 19, "claim 2" should be deleted Signed and Sealed this Second Day of April, 2002

*Attest:*

*Attesting Officer*

JAMES E. ROGAN
*Director of the United States Patent and Trademark Office*